US009248458B1

(12) United States Patent
Wang

(10) Patent No.: US 9,248,458 B1
(45) Date of Patent: Feb. 2, 2016

(54) TRANSVERSE-AXIS IMPACT SPRINKLER

(71) Applicant: Cheng-An Wang, Lu Kang Town (TW)

(72) Inventor: Cheng-An Wang, Lu Kang Town (TW)

( * ) Notice: Subject to any disclaimer, the term of this patent is extended or adjusted under 35 U.S.C. 154(b) by 0 days.

(21) Appl. No.: 14/570,525

(22) Filed: Dec. 15, 2014

(51) Int. Cl.
*B05B 3/00* (2006.01)
*B05B 3/04* (2006.01)
*B05B 1/20* (2006.01)

(52) U.S. Cl.
CPC .... *B05B 3/04* (2013.01); *B05B 1/20* (2013.01)

(58) Field of Classification Search
CPC ..... A01C 25/02; A01C 25/09; B05B 3/044; B05B 3/14; B05B 7/06; B05B 15/063; B05B 15/067; E01C 19/176
USPC ..... 239/225.1, 230, 240, 550, 554
See application file for complete search history.

(56) References Cited

U.S. PATENT DOCUMENTS 3,332,624 A * 7/1967 Rinkewich ..... B05B 1/1654 239/242
3,647,140 A * 3/1972 Perrot ..... B05B 3/044 239/242
3,827,637 A * 8/1974 Stephany ..... B05B 1/202 239/242
5,657,928 A * 8/1997 Jian ..... B05B 1/3026 239/242
7,325,756 B1 * 2/2008 Giorgis ..... A01G 25/09 239/304
7,607,590 B2 * 10/2009 Nies ..... B05B 15/066 239/242

* cited by examiner

*Primary Examiner* — Davis Hwu
(74) *Attorney, Agent, or Firm* — Egbert Law Offices, PLLC

(57) ABSTRACT

A transverse-axis impact sprinkler has a base, pivot joint frame, water inlet pipe, front transverse watering pipe, impact guiding frame, and a pivot angle controlling mechanism. The water introduced by the water inlet pipe will firstly pass through the front transverse watering pipe, and then is sent to the water spout provided on the turning pipe portion of the impact guiding frame, to drive the front transverse watering pipe to rotate synchronously along the swing of the impact guiding frame. The impact sprinkler is of a simplified structure, has a reduced failure rate and enhanced durability and ease of use.

6 Claims, 5 Drawing Sheets

TRANSVERSE-AXIS IMPACT SPRINKLER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT Not applicable.

REFERENCE TO AN APPENDIX SUBMITTED ON COMPACT DISC Not applicable.

BACKGROUND OF THE INVENTION

1. Field of the Invention

The present invention relates generally to a watering and irrigating product, and more particularly to an innovative structural design of a transverse-axis impact sprinkler.

2. Description of Related Art Including Information Disclosed Under 37 CFR 1.97 and 37 CFR 1.98.

Based on different functions, there are many different types of watering products seen in the current market, such as hand-held water pistols, vertical sprinklers, fixed sprinklers, pendant sprinklers etc. The present invention is targeted to the structure of fixed sprinklers. This type of fixed sprinkler is to be placed on or planted in the ground, and its functional appeal is the ease of movement.

The spouting portion of fixed sprinklers also have various structural designs, such as revolving type or swinging type etc. In the case of swinging type, usually a complex gearing mechanism is used in a traditional sprinkler to control the swing of the watering pipe. However, due to the complex actuating structure, the manufacturing cost is very high. Hence, for the manufacturers, the traditional design does not have good cost-effectiveness and good industrial applicability. Moreover, the complex structure also leads to a high failure rate. Indeed, it can not meet the quality requirements for practicability and durability.

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Through innovative and unique structures and technical characteristics of the base, the pivot joint frame, the water inlet pipe, the front transverse watering pipe, the impact guiding frame, and the pivot angle controlling mechanism, the "transverse-axis impact sprinkler" disclosed in the present invention surpasses the existing structure mentioned in "prior art" in that, the water introduced by the water inlet pipe will firstly pass through the front transverse watering pipe, and then sent to the water spout provided on the turning pipe portion of the impact guiding frame, to drive the front transverse watering pipe to rotate synchronously along the swing of the impact guiding frame. Based on this, the impact sprinkler provides practical inventive steps of simplified structure, reduced failure rate and enhanced durability and ease of use.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
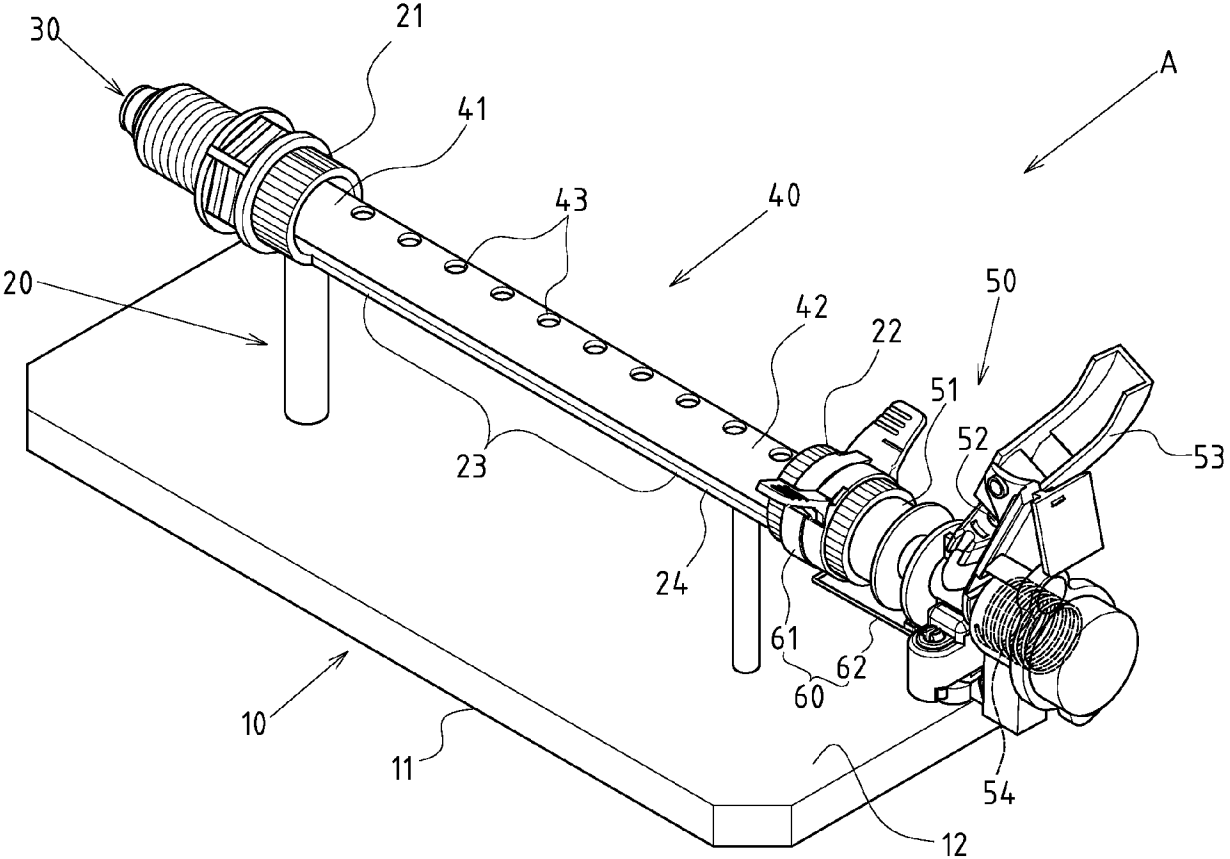
FIG. 1 is a combined perspective view of a preferred embodiment of the present invention.
Figure 2:
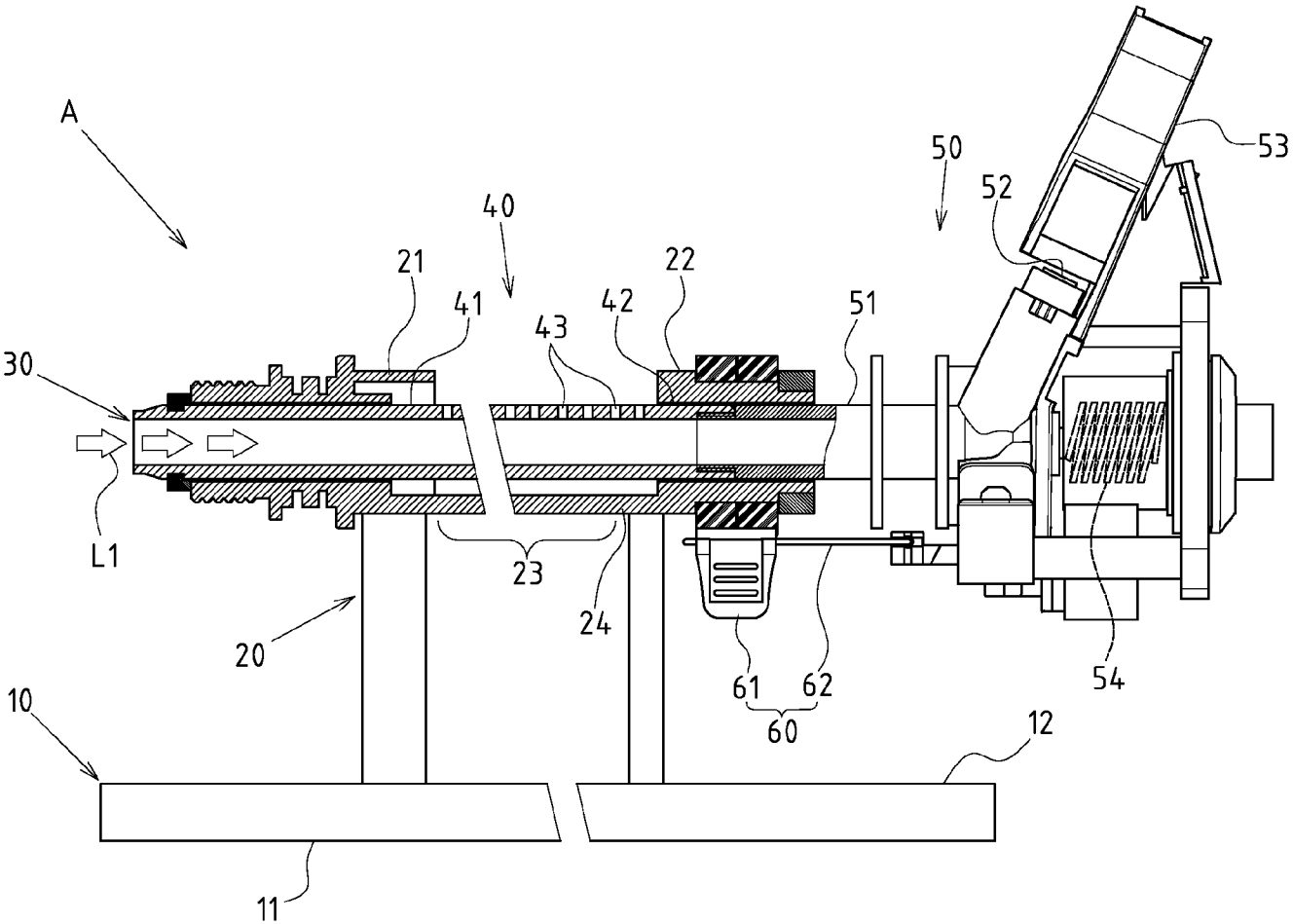
FIG. 2 is a combined plane sectional view a preferred embodiment of the present invention.
Figure 3:
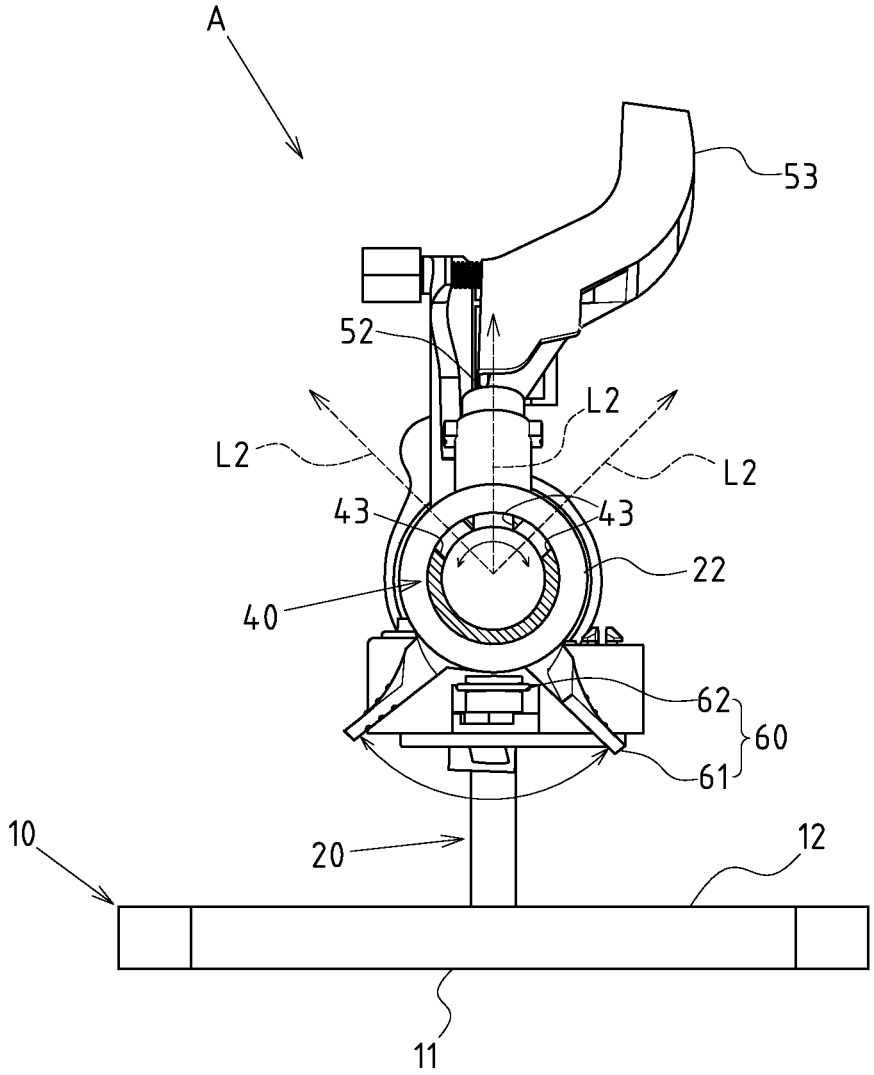
FIG. 3 is a schematic view of the present invention with the front transverse watering pipe swinging synchronously along with the impact guiding frame.

Referring to FIGS. 1, 2, and 3, a preferred embodiment of the present invention of an impact sprinkler is disclosed. However, such an embodiment is for illustrative purposes only, and is not intending to limit the scope of patent application. Said impact sprinkler A comprises a base 10, including a fixing portion 11 and an installing seat portion 12. A pivot joint frame 20 is convexly provided on the installing seat portion 12 of the base 10, said pivot joint frame 20 having a front mounting frame portion 21 and a back mounting frame portion 22 spaced from each other in the transverse direction, said front mounting frame portion 21 and back mounting frame portion 22 define a separating space 23 therebetween. A water inlet pipe 30 is provided on the front mounting frame portion 21 of the pivot joint frame 20, to inlet water. A front transverse watering pipe 40 is assembled between the front mounting frame portion 21 and the back mounting frame portion 22 of the pivot joint frame 20 in the transverse direction and in a rotary state, said front transverse watering pipe 40 including a front pipe segment 41 and a rear pipe segment 42, wherein said front pipe segment 41 is fixed inside the front mounting frame portion 21 in a rotary manner and is communicated with the water inlet pipe 30, while said rear pipe segment 42 is fixed inside the back mounting frame portion 22 in a rotary manner, and moreover, the upper side of said front transverse watering pipe 40 is provided with a plurality of watering holes 43 distributed at intervals, the location of such watering holes 43 corresponds to the location of the separating space 23 between the front mounting frame portion 21 and the back mounting frame portion 22. An impact guiding frame 50 is assembled on the rear pipe segment 42 of the front transverse watering pipe 40 in a state to swing around the transverse axis, said impact guiding frame 50 including a turning pipe portion 51 to be connected to and fixed on the rear pipe segment 42 of the front transverse watering pipe 40, a water spout 52 provided on one position of the turning pipe portion 51, an impact frame 53 provided on the corresponding position of the water spout 52 of the turning pipe portion 51, and an elastic piece 54 to enable the impact frame 53 to generate an impact elastic force. A pivot angle controlling mechanism 60 including an adjustable limiting component 61 and a coupling frame 62, is provided at a fixed position on the pivot joint frame 20 or the base 10 corresponding to the turning pipe portion 51 of the impact guiding frame 50, to adjust and limit the swing angle range of the impact guiding frame 50. Thus, the water introduced from the water inlet pipe 30 will firstly pass through the front transverse watering pipe 40 to the water spout 52 provided on the turning pipe portion 51 of the impact guiding frame 50, and through the swing of the impact guiding frame 50, the front transverse watering pipe 40 is synchronously driven to rotate.

Based on the above structural design, in actual use of the impact sprinkler A disclosed in the present invention, external water is introduced through the water inlet pipe 30, the inlet water will firstly pass through the front transverse watering pipe 40, and sprayed out from the watering holes 43 for watering and irrigation, then the water will again be sent to the water spout 52 provided on the turning pipe portion 51 of the impact guiding frame 50, to drive the front transverse watering pipe 40 to rotate synchronously along the swing of the impact guiding frame 50, so that the front transverse watering pipe 40 can swing in a reciprocated manner. The present invention uses the simple driving structure of an existing impact guiding frame 50 to realize reciprocated swing, omitting the prior-art complex gearing mechanism, and provides such benefits of simplified structure, easy assembly, and lowered cost.

Referring to FIGS. 1 and 2, the bottoms of the front mounting frame portion 21 and back mounting frame portion 22 of the pivot joint frame 20 can be linked through a transverse frame portion 24 to form an integral structure.

Referring to FIGS. 1 and 2, the coupling frame 62 of the pivot angle controlling mechanism 60 can also be provided at a position on the bottom of the turning pipe portion 51 of the impact guiding frame 50. The adjustable limiting component 61 of the pivot angle controlling mechanism 60 can be provided at a position on the back mounting frame portion 22 of the pivot joint frame 20.

Figure 4:
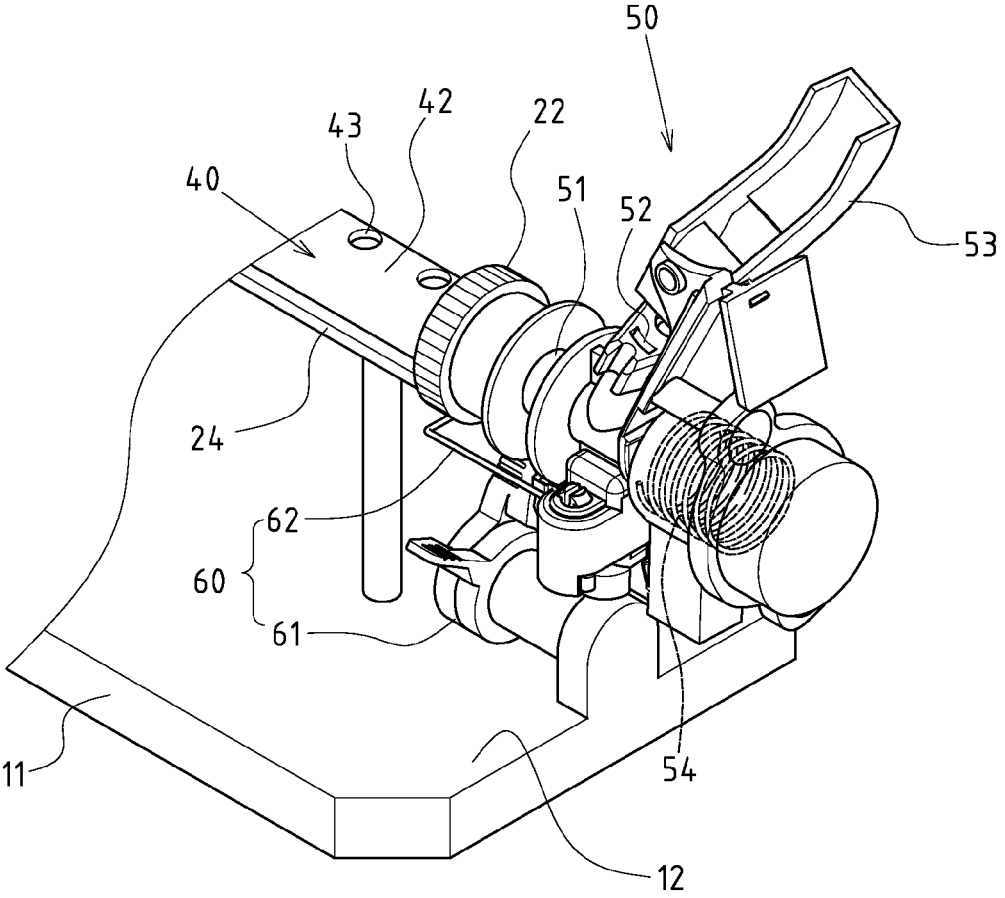
FIG. 4 is a drawing of another embodiment of the design of the pivot angle controlling mechanism of the present invention.

Referring to FIG. 4, the coupling frame 62 of the pivot angle controlling mechanism 60 can also be provided at a position on the bottom of the turning pipe portion 51 of the impact guiding frame 50. The adjustable limiting component 61 of the pivot angle controlling mechanism 60 can be provided at a position on the installing seat portion 12 of the base 10.

Referring to FIGS. 1 and 2, the front mounting frame portion 21 and back mounting frame portion 22 of the pivot joint frame 20 can be configured as hollow tubes.

Figure 5:
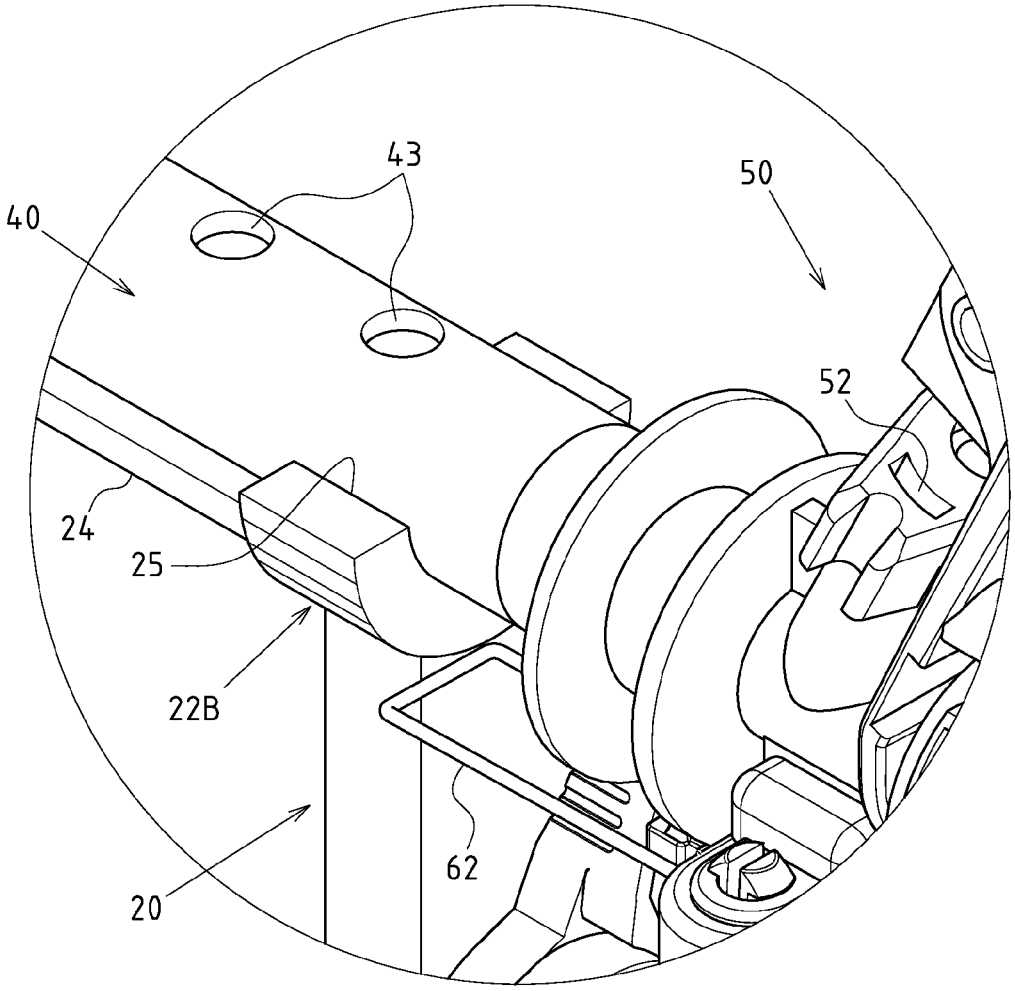
FIG. 5 is a drawing of another embodiment of the back mounting frame portion of the pivot joint frame of the present invention.

Referring to FIG. 5, the back mounting frame portion 22B of the pivot joint frame 20 can also be configured as a supporting frame with its upper side having a notch 25.

I claim:

1. A transverse-axis impact sprinkler, comprising:

a base, including a fixing portion and an installing seat portion;

a pivot joint frame, convexly provided on the installing seat portion of the base, said pivot joint frame having a front mounting frame portion and a back mounting frame portion spaced from each other in the transverse direction, said front mounting frame portion and back mounting frame portion define a separating space therebetween;

a water inlet pipe, provided on the front mounting frame portion of the pivot joint frame, to inlet water;

a front transverse watering pipe, assembled between the front mounting frame portion and the back mounting frame portion of the pivot joint frame in the transverse direction and in a rotary state, said front transverse watering pipe including a front pipe segment and a rear pipe segment, wherein said front pipe segment is fixed inside the front mounting frame portion in a rotary manner and is communicated with the water inlet pipe, while said rear pipe segment is fixed inside the back mounting frame portion in a rotary manner, and moreover, the upper side of said front transverse watering pipe is provided with a plurality of watering holes distributed at intervals, the location of such watering holes corresponds to the location of the separating space between the front mounting frame portion and the back mounting frame portion;

an impact guiding frame, assembled on the rear pipe segment of the front transverse watering pipe in a state to swing around the transverse axis, said impact guiding frame including a turning pipe portion to be connected to and fixed on the rear pipe segment of the front transverse watering pipe, a water spout provided on one position of the turning pipe portion, an impact frame provided on the corresponding position of the water spout of the turning pipe portion, and an elastic piece to enable the impact frame to generate an impact elastic force;

a pivot angle controlling mechanism, including an adjustable limiting component and a coupling frame, provided at a fixed position on the pivot joint frame or the base corresponding to the turning pipe portion of the impact guiding frame, to adjust and limit the swing angle range of the impact guiding frame;

thus, the water introduced from the water inlet pipe will firstly pass through the front transverse watering pipe to the water spout provided on the turning pipe portion of the impact guiding frame, and through the swing of the impact guiding frame, the front transverse watering pipe is synchronously driven to rotate.

2. The structure defined in claim 1, wherein the bottoms of the front mounting frame portion and back mounting frame portion of the pivot joint frame is linked through a transverse frame portion to form an integral structure.

3. The structure defined in claim 2, wherein the coupling frame of the pivot angle controlling mechanism is provided at a position on the bottom of the turning pipe portion of the impact guiding frame; the adjustable limiting component of the pivot angle controlling mechanism is provided at a position on the back mounting frame portion of the pivot joint frame.

4. The structure defined in claim 2, wherein the coupling frame of the pivot angle controlling mechanism is provided at a position on the bottom of the turning pipe portion of the impact guiding frame; the adjustable limiting component of the pivot angle controlling mechanism is provided at a position on the installing seat portion of the base.

5. The structure defined in claim 3, wherein the front mounting frame portion and back mounting frame portion of the pivot joint frame are configured as hollow tubes.

6. The structure defined in claim 4, wherein the back mounting frame portion of the pivot joint frame is configured as a supporting frame with its upper side having a notch.

* * * * *